US008342154B2

(12) United States Patent
Scholz

(10) Patent No.: US 8,342,154 B2
(45) Date of Patent: Jan. 1, 2013

(54) DEVICE FOR SUPPLYING FUEL FOR AN ENGINE AND METHOD FOR MOUNTING A FUEL FEED LINE

(75) Inventor: Klaus Scholz, Hamburg (DE)

(73) Assignee: Makita Corporation, Anjo (JP)

( * ) Notice: Subject to any disclaimer, the term of this patent is extended or adjusted under 35 U.S.C. 154(b) by 0 days.

(21) Appl. No.: 12/899,811

(22) Filed: Oct. 7, 2010

(65) Prior Publication Data

US 2011/0083630 A1 Apr. 14, 2011

(30) Foreign Application Priority Data

Oct. 13, 2009 (DE) ..... 20 2009 013 882 U
Mar. 27, 2010 (DE) ..... 20 2010 004 275 U

(51) Int. Cl.
*F02M 55/02* (2006.01)
*F02M 55/00* (2006.01)

(52) U.S. Cl. ..... 123/468; 285/124.4

(58) Field of Classification Search ..... 123/468, 123/469, 514, 509; 285/136.1, 124.4, 239, 285/124.1
See application file for complete search history.

(56) References Cited

U.S. PATENT DOCUMENTS 2,120,975 A * 6/1938 Heftler ..... 261/72.1
3,738,625 A * 6/1973 Thompson ..... 261/68
4,353,847 A * 10/1982 Sato et al. ..... 261/36.2
4,835,866 A 6/1989 Nagashima
5,117,796 A * 6/1992 Tursky ..... 123/509
5,197,426 A 3/1993 Frangesch et al.
5,211,547 A * 5/1993 Gaston et al. ..... 417/360
5,239,967 A 8/1993 Adam
5,261,375 A 11/1993 Rush, II et al.
2004/0194760 A1 10/2004 Streb et al.
2006/0042601 A1 3/2006 Hotta et al.

FOREIGN PATENT DOCUMENTS

DE 41 42 354 A1 6/1993
DE 197 42 908 A1 4/1998
DE 10 2007 022 116 A1 11/2008
DE 10 2007 029 617 A1 1/2009
FR 2 685 389 6/1993

OTHER PUBLICATIONS

German Search Report issued in Application No. 20 2010 004 275.5; dated Nov. 9, 2010 (with translation).
German Search Report dated Aug. 6, 2010 in German Patent Application No. 20 2009 013 882.8 (with translation).
European Search Report issued Aug. 23, 2011 for European Patent Application No. EP 10 18 6884 (with translation).

* cited by examiner

*Primary Examiner* — Mahmoud Gimie
(74) *Attorney, Agent, or Firm* — Oliff & Berridge, PLC

(57) ABSTRACT

In order to create a device for supplying fuel, with a connecting piece for connecting at least one fuel line of an engine, in particular an engine of a small piece of equipment, for example for garden, forest or landscape maintenance or for example of a motorized tool or the like, wherein an intake manifold is provided which is arranged adjacently to a fuel tank, with an improved arrangement of a connecting piece of a device for supplying fuel of an engine, it is proposed that the intake manifold has a retaining device for the retentive arrangement of the connecting piece on the intake manifold.

12 Claims, 3 Drawing Sheets

DEVICE FOR SUPPLYING FUEL FOR AN ENGINE AND METHOD FOR MOUNTING A FUEL FEED LINE

Figure 1:
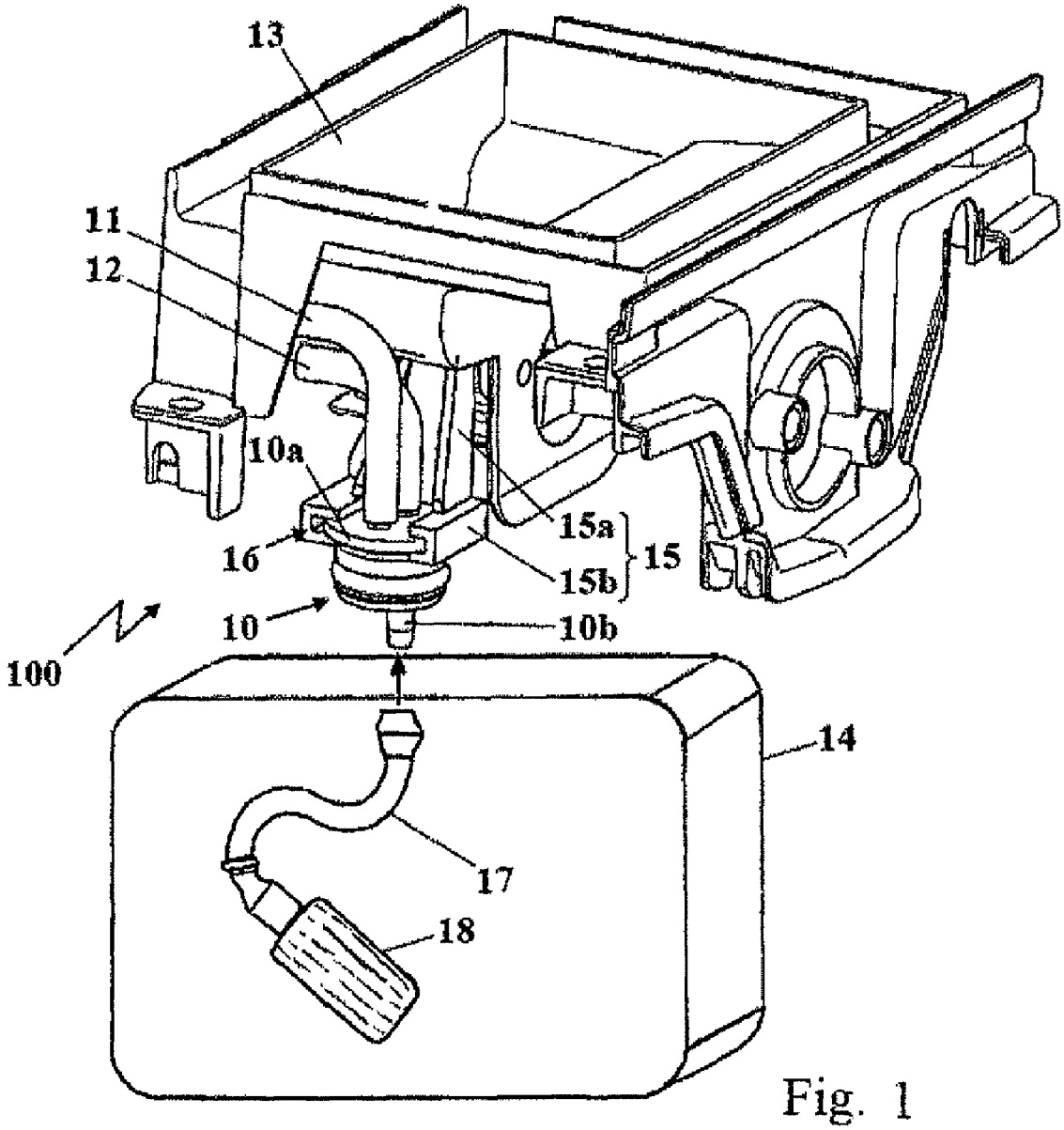

The present invention relates to a device for supplying fuel, with a connecting piece for connecting at least one fuel line of an engine, in particular an engine of a small piece of equipment, for example for garden, forest or landscape maintenance or for example of a motorised tool or the like, wherein an intake manifold is provided which is arranged adjacently to a fuel tank.

PRIOR ART

DE 10 2007 029 617 A1 discloses a generic device for supplying fuel, with a connecting piece for connecting at least one fuel line of an engine. The connecting piece is inserted in the fuel tank of the engine and built in together with it. The disadvantage arises that the fuel lines can only be mounted on the connecting piece after the fuel tank with the connecting piece has been inserted. The connecting piece is often situated in a poorly accessible position on the engine or on the small piece of equipment, as a result of which the process of attaching the fuel line to the connecting piece is time-consuming and complicated.

DESCRIPTION OF THE INVENTION

Object, Solution, Advantages

It is therefore the object of the present invention to create an improved arrangement of a connecting piece of a device for supplying fuel of an engine. It is further the object of the present invention to create an improved method for mounting the device for supplying fuel.

This object is achieved progressing from a device for supplying fuel for an engine according to Claim 1 and according to Claim 8. Advantageous developments of the invention are specified in the dependent claims.

The invention includes the technical teaching that the intake manifold has a retaining device for the retentive arrangement of the connecting piece on the intake manifold.

The arrangement according to the invention of the connecting piece on the intake manifold produces the advantage that an assembly which can be preassembled with intake manifold, connecting piece and fuel lines already connected to the connecting piece is created and provided. This assembly can be supplied as a unit which can be handled individually for assembling the engine or the small piece of equipment. The intake manifold does not just describe a component with the function of introducing charge air. The intake manifold can also be understood as an air filter holding element or as a bridge element for the retentive arrangement of the carburettor unit of the engine, wherein the charge air is conducted through the intake manifold. The intake manifold according to the present invention basically describes any possible component which is mounted adjacently to the fuel tank and can fulfil different functions in order to allow only among other things a retentive arrangement of the connecting piece likewise adjacently to or in the fuel tank according to the invention.

One advantageous configuration of the intake manifold provides for it to be an injection-moulded plastic component or a die-cast metal component. The intake manifold and the retaining device can in particular be in one piece and preferably materially integral with each other, and preferably produced by a common production step. Alternatively the possibility exists of injection moulding the retaining device onto the structure of the intake manifold. The present invention is however also aimed at configurations of the retaining device which are attached to the intake manifold by means of connection elements, for example by means of screw connections. The retaining device can also be clipped onto the intake manifold or attached in a loss-proof manner to the intake manifold by means of other form-fitting geometries. The connecting piece can likewise be arranged in any manner on the retaining device, for example by adhesive bonding or for example by a plastic fusing process. The connecting piece can also be in one piece with the retaining device and consequently with the intake manifold in order to bring about a further reduction in individual parts. The intake manifold, the retaining device and the connecting piece can thus be produced in one process step, for example in a plastic injection-moulding step or in a metal die-casting step.

According to a further advantageous embodiment, the retaining device has a shaft section and a socket section, so that the socket section is arranged at a distance from the intake manifold by means of the shaft section. The socket section is arranged at the end of the shaft section so that the shaft section extends between the intake manifold and the socket section. The shaft section has a defined length in such a manner that, when the intake manifold is arranged adjacently to the fuel tank of the small piece of equipment, a positionally precise arrangement of the connecting piece on or in the fuel tank is made possible.

In order to compensate a positional tolerance between the connecting piece and the intake manifold, the socket section can preferably have a guide geometry in which a push-in and holding section of the connecting piece is accommodated such that it can be moved in at least one direction. The guide geometry can be a dovetail guide or a groove guide so that the guide geometry has grooves at a distance from each other and with their openings pointing towards each other, into which the push-in and holding section can be introduced from a guide direction. This guide direction corresponds in the installed state to the direction of the tolerance compensation, as long as the connecting piece has to have a defined position with respect to the fuel tank and a positional deviation between the arrangement of the intake manifold and the fuel tank must be compensated. The push-in and holding section can as a relatively flat component be round, rectangular or square. A preferred embodiment has laterally raised walls so that a U shape is produced.

The push-in and holding section can advantageously be configured such that the connecting piece can be accommodated in a preferential direction in the guide geometry, The configuration of the push-in and holding section for defining a preferential direction for insertion into the guide geometry can for example have an asymmetry so that the connecting piece can only be introduced into the guide geometry in one direction. The push-in and holding section of the connecting piece can for example have shoulders which form a stop when the connecting piece is pushed far enough into the guide geometry. The shoulders prevent the connecting piece from being inserted into the guide geometry in the wrong direction, and at the same time hoses are prevented from being connected incorrectly to the connecting piece.

The connecting piece can further advantageously be latched by means of a locking means which is arranged on the connecting piece. This can further facilitate the mounting, as the connecting piece can be arranged in a self-retaining manner in the socket section of the retaining device. The locking means can in particular be integrally formed on the push-in and holding section. Consequently it no longer has to be held manually in the socket section when the device for supplying fuel is mounted. The locking means can be a locking tongue which latches in the manner of a snap hook in a locking opening or behind a locking edge which is introduced in the retaining device.

The connecting piece advantageously has at least one sealing element which is provided for sealing off the connecting piece at least in an opening in the fuel tank and/or in a further socket. The fuel tank can preferably have an opening into which the connecting piece can be inserted such that it is sealed by at least one sealing element. Further advantageously, the connecting piece can have at least one second sealing element so that the connecting piece can also be inserted in a sealing manner in a socket, for example in a housing. In addition to the fuel tank, an overflow chamber can in particular be provided, which must be sealed off from the fuel tank on one side and from the environment on the other, so that the requirement of the second sealing element on the connecting piece is produced. The sealing elements can be O-rings which are accommodated in corresponding grooves which are introduced in the for example cylindrical basic geometry of the connecting piece. Oval, barrel-shaped or else polygonal basic geometries are conceivable. The connecting piece extends then with this cylindrical section in the mounted state through the overflow chamber into the opening of the fuel tank.

It is further advantageous that the connecting piece has at least one tank connector which projects into the fuel tank when the intake manifold, fuel tank and connecting piece on the intake manifold are mounted. The connecting piece, which can also be referred to as a fuel nipple, consequently forms a connection element between a suction line with a suction head and the at least one fuel line. The suction line with the suction head which is present at the end of the suction line is accommodated in the fuel tank itself, The tank connector of the connecting piece projects into the interior of the fuel tank when mounted on the fuel tank, so that the suction line is attached to the tank connector, for example by pushing the suction line onto the tank connector. The suction head has a certain weight to ensure reliable intake of fuel in any working position of the small piece of equipment. The suction line is therefore a flexible hose, for example a silicone hose.

On the outer side of the connecting piece which faces away from the fuel tank, the connecting piece can, according to a first embodiment, have two connectors onto which the fuel lines are placed. A first fuel line is used to remove the fuel from the fuel tank, a second fuel line being used to return a quantity of fuel which is not needed to the fuel tank. Consequently, the tank connector onto which the suction line with the suction head is placed is connected fluidically within the connecting piece to the fuel line which is used to drain the fuel out of the fuel tank. The connector onto which the second fuel line for returning the fuel to the fuel tank is placed opens only into a bore, through which the fuel flows back into the fuel tank, the bore ending for example on the underside of the flat push-in and holding section of the connecting piece.

According to a second embodiment, the connecting piece can have at least one suction connector, a return connector and a ventilation connector. The suction connector and the return connector correspond to the two other connectors according to the first embodiment described above. According to the second embodiment, a ventilation connector can also be provided.

Fuel can be sucked out of the fuel tank via the suction connector, the fuel tank being connected to a ventilation connector for ventilation. A vacuum cannot thus be produced in the fuel tank, as sufficient air can get into the tank via the ventilation connector when fuel is removed from the tank.

In addition to the fuel tank, an overflow chamber can be provided according to this embodiment, which overflow chamber is connected fluidically to the return connector. As a result the connecting piece has on its side facing away from the fuel tank the three described connectors, and the connecting piece forms the central connection point between the fuel tank and the intake manifold/carburettor including a ventilation valve. According to this embodiment, there are preferably only these connections between the fuel tank or the overflow chamber and the carburettor/intake region.

The present invention further relates to a method for mounting a device for supplying fuel, with a connecting piece for connecting at least one fuel line of an engine, in particular an engine of a small piece of equipment, for example for garden, forest or landscape maintenance or for example of a motorised tool or the like, wherein the mounting comprises the arrangement of an intake manifold which is arranged adjacently to a fuel tank. According to the invention, the method comprises at least two steps, namely a first mounting step, in which the connecting piece is arranged on the intake manifold by means of a retaining device, and a second mounting step, in which the intake manifold is arranged adjacently to a fuel tank with simultaneous joining of the connecting piece in and/or to the fuel tank.

According to at least one further method step, it is provided for at least one fuel line to be arranged on the connecting piece before and/or during the arrangement of the connecting piece on the intake manifold by means of the retaining device. Both fuel lines are preferably connected to the connecting piece before the arrangement of the connecting piece on the intake manifold so that directly afterwards the connecting piece is mounted on the intake manifold by means of the retaining device. A structural unit of the connecting piece with the intake manifold which is subsequently arranged adjacently to the fuel tank is thus produced. The fuel lines are preferably both already connected to the connecting piece.

According to a further method step, the suction line with the suction head is attached to the connecting piece so that the suction line with the suction head projects into the fuel tank. The connection between the suction line and the connecting piece is produced before the arrangement of the connecting piece on the fuel tank. The suction line with the suction head must consequently be introduced into the opening in the fuel tank in order then to ensure a correct fit of the connecting piece in the opening of the fuel tank when the intake manifold is arranged adjacently to the fuel tank.

SHORT DESCRIPTION OF THE DRAWINGS

Figure 2:
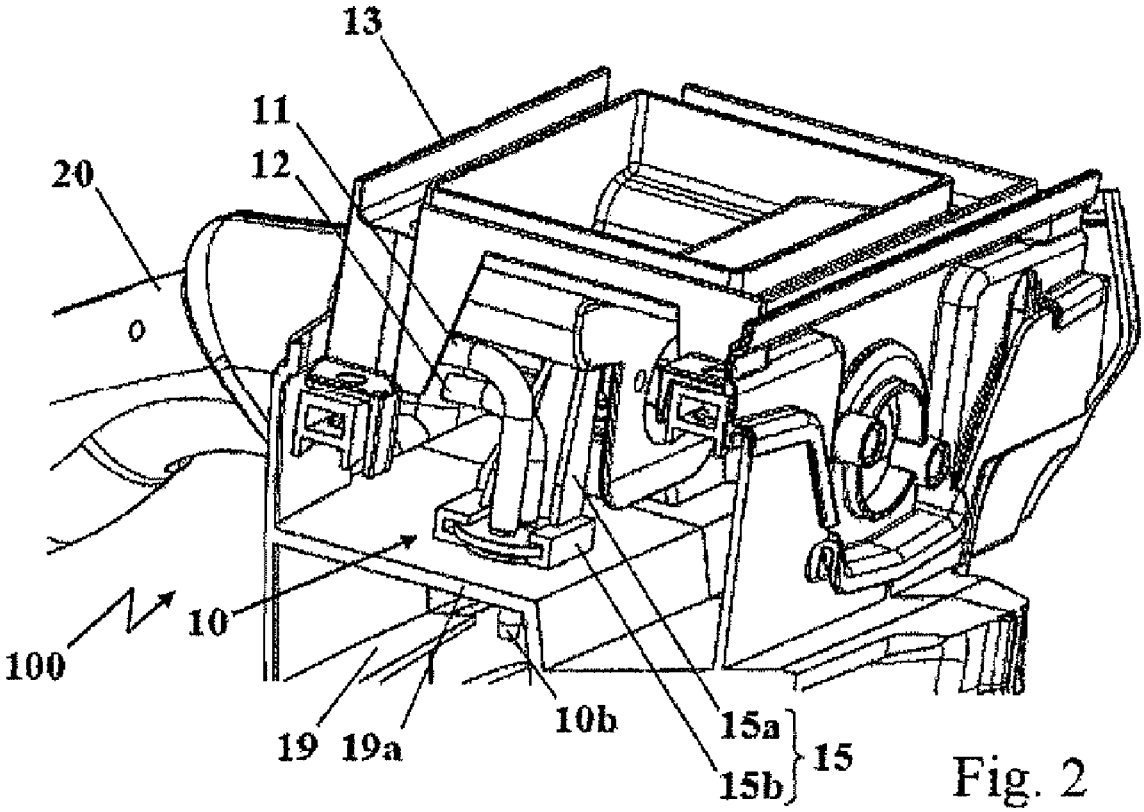
Figure 3:
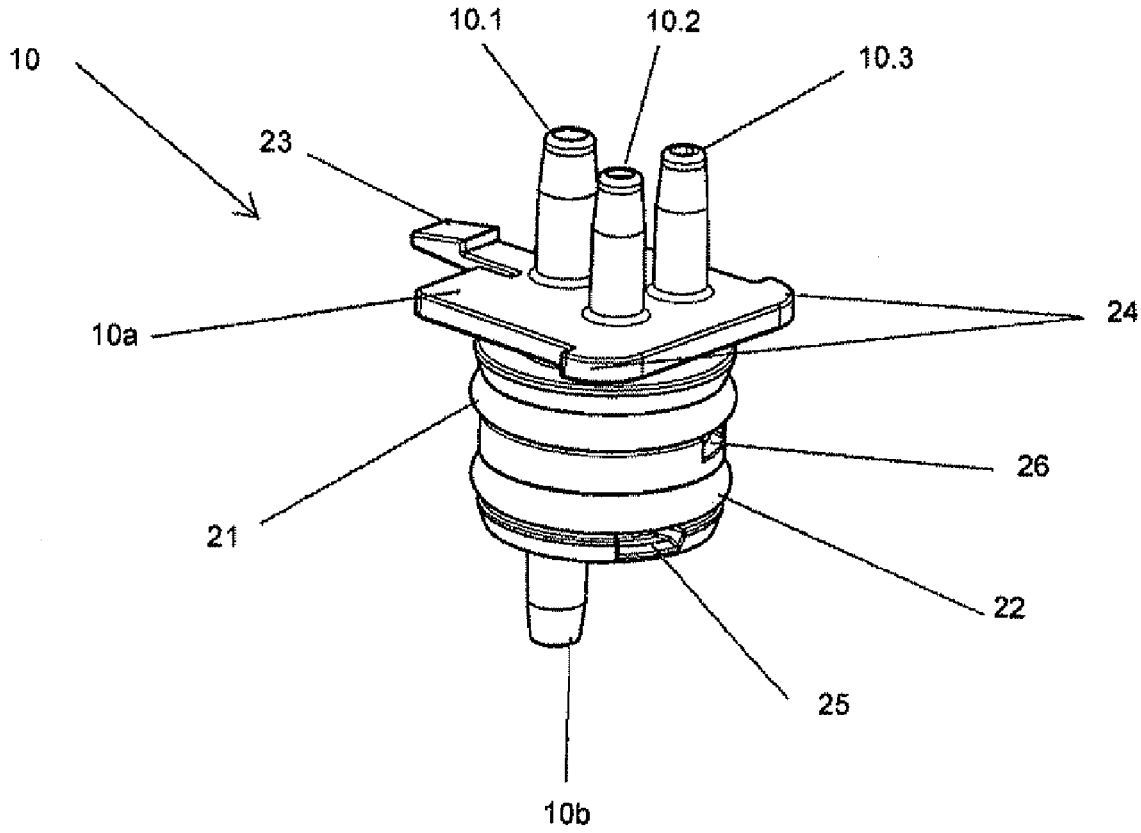

Further measures which improve the invention are presented in more detail below together with the description of preferred exemplary embodiments of the invention, with the aid of the figures. In the figures, FIG. 1 schematically shows a perspective view of an exemplary embodiment of a device for supplying fuel with an arrangement according to the invention of a connecting piece on the intake manifold, FIG. 2 schematically shows a further perspective view of an exemplary embodiment of the device according to the invention for supplying fuel, and FIG. 3 schematically shows a further exemplary embodiment of a connecting piece in a perspective view.

PREFERRED EMBODIMENT OF THE INVENTION

FIG. 1 shows in a perspective view an exemplary embodiment of a device 100 for supplying fuel for an engine of a small piece of equipment. The device 100 comprises a connecting piece 10, which can also be referred to as a fuel nipple and forms a connection element between a suction line 17 with a suction head 18 and a fuel line 11 and 12. The fuel line 11 is used to return unused fuel to the fuel tank 14, the fuel line 12 being connected fluidically to a tank connector 10*b* of the connecting piece 10. The suction line 17 is pushed onto the tank connector 10*b* so that fuel can be sucked out of the fuel tank 14 via the fuel line 12.

The connecting piece 10 is arranged according to the invention in a retentive manner on an intake manifold 13. To this end, the intake manifold 13 has a retaining device 15, and the connecting piece 10 can be connected to the intake manifold 13 before being arranged on the fuel tank 14 by means of the retaining device 15. To this end, the retaining device 15 has a shaft section 15*a* and a socket section 15*b*. The shaft section 15*a* extends between the intake manifold 13 and a socket section 15*b* for accommodating the connecting piece 10 so that the latter forms a distance from the underside of the intake manifold 13 pointing in the direction of the fuel tank 14. A structural unit is thus produced consisting of the intake manifold 13 and the connecting piece 10, which can be handled as a structural unit during the assembly of the engine and can be mounted simply on the fuel tank 14.

The intake manifold 13 is an injection-moulded plastic component or a die-cast metal component so that the shaft section 15*a* merges in one piece and in a materially integral manner into the body of the intake manifold 13, the socket section 15*b* likewise being connected in one piece and in a materially integral manner to the shaft section 15*a* to create the retaining device 15 in a simple manner. The socket section 15*b* has a guide geometry 16 into which the connecting piece 10 can be pushed by means of a flat push-in and holding section 10*a*. If the intake manifold 13 is arranged in its required position relative to the fuel tank 14 during mounting, a tank connector 10*b* of the connecting piece 10 projects into the fuel tank 14. The connecting piece 10 has a cylindrical basic geometry which is inserted into an opening (not shown in detail) in the fuel tank 14. The connecting piece 10 thus achieves a defined position inside the guide geometry 16, at the same time creating the possibility of compensating tolerances.

If the method for mounting the device 100 for supplying fuel is carried out with the connecting piece 10, the assembly consisting of the intake manifold 13 and the connecting piece 10 is preassembled, the fuel lines 11 and 12 preferably also already being connected to the connecting piece 10. Only then is the suction line 17 with the suction head 18 attached to the tank connector 10*b* of the connecting piece 10, indicated by an arrow between the suction line 17 and the tank connector 10*b*. Only then is this assembly attached adjacently to the fuel tank 14 while at the same time introducing the suction line 17 with the suction head 18 into the fuel tank 14. Alternatively, it can also be provided for the suction head to be mounted separately through the tank opening after the suction line has been mounted, if particularly large suction heads are used.

FIG. 2 shows in a further perspective view the device 100 for supplying fuel, the arrangement of the connecting piece 10 by means of the retaining device 15 with the shaft section 15*a* and the socket section 15*b* being shown in the same manner as has already been described in FIG. 1. The arrangement of the intake manifold 13 with the connecting piece 10 takes place according to this exemplary embodiment adjacently to a housing 19 which is provided for accommodating a fuel tank (not shown in detail). The fuel tank is arranged on the underside of the housing wall 19*a* so that at least the tank connector 10*b* extends through the housing wall 19*a* in order to be inserted into the fuel tank. The connecting piece 10 is situated on the top of the housing wall 19*a* so that the socket section 15*b* is arranged approximately adjacently to the top side of the housing wall 19*a*. Consequently there is an advantageous possibility of mounting the fuel tank 14 in the housing 19 before arranging the intake manifold 13 with the connecting piece 10 on the housing 19. The housing 19 can for example have a handle 20 which can even be formed in one piece with the intake manifold 13. Operating elements for controlling the engine can be integrated in the handle 20 in order to control the small piece of equipment.

FIG. 3 shows a further possible exemplary embodiment of a connecting piece 10 which can be arranged according to the present invention by means of a retaining device 15 on the intake manifold 13. The connecting piece 10 has a cylindrical basic geometry. Three connectors are shown on a side, which faces away from the fuel tank 14, of the cylindrical basic geometry. These relate to a suction connector 10.1, a ventilation connector 10.2 and a return connector 10.3.

The suction connector 10.1 is connected fluidically to a tank connector 10*b* which is arranged on the side facing the fuel tank 14 and projects into the fuel tank 14 when the connecting piece 10 is inserted into an opening in the fuel tank 14 according to its intended use. The ventilation connector 10.2 is connected fluidically to a ventilation opening 25 which is made laterally in the cylindrical section of the connecting piece 10. If fuel is sucked out of the fuel tank 14, for example air can get back into the fuel tank 14 via the ventilation connector 10.2 and the ventilation opening 25 connected to this to prevent a vacuum being produced in the fuel tank 14.

Furthermore, a return opening 26 is present laterally on the cylindrical section of the connecting piece 10, which opening is fluidically connected to the return connector 10.3 and is used to return a quantity of fuel which is not needed. The return opening 26 is situated like the ventilation opening 25 on a section of the cylindrical basic geometry of the connecting piece 10 which can extend through an overflow chamber so that the quantity of fuel which is not needed is returned to the overflow chamber.

Sealing elements 21 and 22 are also inserted into the cylindrical section of the connecting piece 10 which divide the cylindrical section of the connecting piece 10 into a plurality of fluidically separate sections. The sealing elements 21 and 22 are O-rings and are arranged circumferentially in the cylindrical section of the connecting piece 10. The section of the connecting piece 10, which has the connectors 10.1, 10.2 and 10.3 projects outwards, can thus be separated fluidically by the sealing elements 21 from the region which extends through the overflow chamber when the connecting piece 10 is inserted into the fuel tank 14. The sealing element 22 finally separates the region of the connecting piece 10 which extends through the overflow chamber from the region of the connecting piece 10 which extends into the fuel tank 14. The sealing element 22 can for example seal off the connecting piece 10 from the opening in the fuel tank 14.

The ventilation opening 25 and the return opening 26 in the cylindrical section of the connecting piece 10 are in each case arranged adjacently to the sealing elements 21, 22 in such a manner that the openings 25 and 26 act as cut-outs in which a tool can engage in order to remove the sealing elements 21, 22 from their respective position in the cylindrical section of the connecting piece 10. The sealing elements 21, 22 can thus for example be replaced more easily if this is necessary.

The connecting piece 10 has a flat push-in and holding section 10*a*. When the connecting piece 10 is inserted into the fuel tank 14, this section is situated on the outwardly facing side and can be arranged in a retentive manner previously in the socket section 15*b* of the retaining device 15 on the intake manifold 13. The push-in and holding section 10*a* has a rectangular basic shape and has shoulders 24 which prevent the connecting piece 10 from being mounted incorrectly on the retaining device, as the push-in and holding section 10*a* can only be arranged in the retaining device 15 on the intake manifold 13 in an intended direction due to the shoulders. Furthermore, a locking means 23 is provided. This can further facilitate the mounting of the connecting piece 10, as the connecting piece 10 can be arranged in a self-retaining manner in the socket section 15*b* of the retaining device 15. Consequently it no longer has to be held manually in the socket section 15*b* when the device for supplying fuel is mounted. The locking means 23 is a locking tongue which can latch in the manner of a snap hook in a locking opening or behind a locking edge which is introduced into the retaining device.

The configuration of the invention is not restricted to the above-described preferred exemplary embodiments. Rather, a number of variants are conceivable which make use of the presented solution even in fundamentally different embodiments. All features and/or advantages arising from the claims, the description or the drawings, including design details, spatial arrangements and method steps can be essential to the invention both by themselves and in different combinations.

LIST OF REFERENCE SYMBOLS

100 Device for supplying fuel
10 Connecting piece
10.1 Suction connector
10.2 Ventilation connector
10.3 Return connector
10*a* Push-in and holding section
10*b* Tank connector
11 Fuel line
12 Fuel line
13 Intake manifold
14 Fuel tank
15 Retaining device
15*a* Shaft section
15*b* Socket section
16 Guide geometry
17 Suction line
18 Suction head
19 Housing
19*a* Housing wall
20 Handle
21 Sealing element
22 Sealing element
23 Locking means
24 Shoulder
25 Ventilation opening
26 Return opening

The invention claimed is:

1. A device for supplying fuel from a fuel tank to an engine via at least one fuel line, the fuel tank defining at least one opening, the device comprising:

a connecting piece having a first end that attaches to the fuel tank and a second end that is attached to the at least one fuel line; and an intake manifold disposed adjacent to the fuel tank, the intake manifold including a retaining device for the retentive arrangement of the connecting piece on the intake manifold, wherein the retaining device has a shaft section and a socket section so that the socket section is arranged at a distance from the intake manifold by means of the shaft section.

2. The device for supplying fuel according to claim 1, wherein the intake manifold is an injection-moulded plastic component or die-cast metal component.

3. The device for supplying fuel according to claim 1, wherein the intake manifold and the retaining device are integrally formed as one piece.

4. The device for supplying fuel according to claim 1, wherein the socket section has a guide geometry in which a push-in and holding section of the connecting piece is accommodated such that it can move in at least one direction.

5. The device for supplying fuel according to claim 4, further comprising:

a locking means arranged on the connecting piece, wherein the push-in and holding section is configured in such a manner that the connecting piece can be accommodated in the guide geometry and can be latched by the locking means.

6. The device for supplying fuel according claim 1, wherein the connecting piece has at least one sealing element, which is provided at the at least one opening in the fuel tank for sealing off the connecting piece.

7. The device for supplying fuel according to claim 1, wherein the connecting piece has at least one tank connector which projects into the fuel tank when the intake manifold, the fuel tank and the connecting piece on the intake manifold are mounted.

8. The device for supplying fuel according to claim 1, wherein the connecting piece has at least one suction connector, one ventilation connector and one return connector.

9. The device for supplying fuel from the fuel tank to the engine via the at least one fuel line, according claim 1, the fuel tank having a suction line with a suction head, the device comprising:

a connection element between the suction line with the suction head and the at least one fuel line, wherein the connecting piece forms the connection element.

10. A method for mounting a device of a fuel feed line including a connecting piece having a first end for connecting to at least one fuel line of an engine and a second end for connecting to a fuel tank, the method comprising:

arranging the connecting piece on an intake manifold by means of a retaining device; and arranging the intake manifold adjacent to the fuel tank while at the same time joining the connecting piece in and/or to the fuel tank, wherein the retaining device has a shaft section and a socket section so that the socket section is arranged at a distance from the intake manifold by means of the shaft section.

11. The method for mounting a device of a fuel feed line according to claim 10, the method further comprising:

arranging at least one fuel line and/or a ventilation connection on the connecting piece before and/or during the arrangement of the connecting piece on the intake manifold by means of the retaining device.

12. The method for mounting a device of a fuel feed line according claim 10, the method further comprising:

providing a suction line with a suction head, which projects into and/or on the fuel tank; and arranging the suction line with the suction head on the tank connector before the connecting piece is joined in and/or on the fuel tank.

* * * * *